US006199504B1

(12) United States Patent
Freeman

(10) Patent No.: US 6,199,504 B1
(45) Date of Patent: Mar. 13, 2001

(54) SOFT SANDWICH BOARD SYSTEM AND METHOD

(75) Inventor: Donald H. Freeman, Clifton, NJ (US)

(73) Assignee: Continental Safety Supply Co., Inc., Clifton, NJ (US)

( * ) Notice: Subject to any disclaimer, the term of this patent is extended or adjusted under 35 U.S.C. 154(b) by 0 days.

(21) Appl. No.: 08/651,862

(22) Filed: May 21, 1996

(51) Int. Cl.[7] ..... E01F 9/00
(52) U.S. Cl. ..... 116/63 C; 116/63 P; 40/610
(58) Field of Search ..... 116/63 C, 63 P, 116/63 T; 40/603, 606, 610, 612

(56) References Cited

U.S. PATENT DOCUMENTS

| | | | | |
|---|---|---|---|---|
| 2,881,662 | * | 4/1959 | Harris | 116/63 P X |
| 2,914,874 | * | 12/1959 | Stein | 40/610 |
| 4,019,271 | * | 4/1977 | Latimer | 116/63 P X |
| 4,875,302 | * | 10/1989 | Noffsinger | 40/610 |
| 4,925,334 | * | 5/1990 | Beard | 116/63 C X |
| 4,928,415 | * | 5/1990 | Walters | 40/610 |
| 5,269,251 | * | 12/1993 | Freeman | 116/63 C |
| 6,095,716 | * | 8/2000 | Kulp et al. | 404/9 |

FOREIGN PATENT DOCUMENTS

| | | | | |
|---|---|---|---|---|
| 2387320 | * | 12/1978 | (FR) | 116/63 C |
| 2077332 | * | 12/1981 | (GB) | 116/63 C |
| 2182701 | * | 5/1987 | (GB) | 116/63 C |

* cited by examiner

*Primary Examiner*—Hezron Williams
*Assistant Examiner*—Michael Cygan
(74) *Attorney, Agent, or Firm*—W. Patrick Quast, Esq.

(57) ABSTRACT

A soft sandwich board is disclosed, being formed utilizing a standard traffic cone. An ultraviolet stabilized nylon shroud is employed to simulate the two sides of a standard A-Stand sign system. The shroud is double sided, with an opening at its top for connection to the cone, and a concentric larger opening at its base for slipping over a square shaped cone weight connected adjacent the base of the cone. A Tee Cone Adapter and crossbar at the top of the cone provides for shaping the shroud into a pair of identical square or rectangularly shaped panels on which warning signs are imprinted, and reflecting strips are attached. Possible damage to vehicles or persons due to collision with these soft sandwich boards, or due to violent weather conditions blowing them about, is minimized.

5 Claims, 6 Drawing Sheets

SOFT SANDWICH BOARD SYSTEM AND METHOD

BACKGROUND

This invention relates to traffic control devices, and in particular to A-Stand sign systems often referred to as sandwich boards.

Sandwich boards are commonly employed for vehicular traffic control, being used as barricades and warning signs. Typically these boards are made of wood, plastic, or metal, having a front and back, and taking the form of the letter "A" when standing in place. While these sandwich boards can be manufactured in light weight plastics, they still present a potentially dangerous object when accidentally struck by a moving vehicle, or by being blown about in heavy wind conditions. The instant invention addresses these problems by converting standard traffic cones into soft sandwich boards having enhanced resistance to violent weather conditions.

It is therefore a primary object of the invention to provide a sandwich board with reduced hazardous potential to vehicles or individuals when struck by a moving vehicle.

An additional object of the invention is to provide a sandwich board with reduced hazardous potential to vehicles or individuals due to high wind conditions.

A further object of the invention is to convert standard traffic cones into sandwich boards rapidly and conveniently during routine traffic control accessory placement procedures.

Still another object of the invention is to make a variety of different warning messages economically and conveniently available by converting standard traffic cones into sandwich boards as required by individual traffic control procedures.

SUMMARY

These and other objects are obtained with the soft sandwich board system and method of the invention.

It has been found that standard traffic cones can be quickly and easily converted into soft sandwich boards, with significantly increased safety if accidentally moved by high winds or collision with a moving vehicle.

Traffic cones are available in a variety of sizes, those being approximately 28" to 36" in height have been found generally well suited for routine traffic control problems. Most traffic cones are hollow, with an opening at the top of the narrow portion of the cone. They are usually fabricated in rubber or an elastomeric plastic material so as to limit damage to vehicles or persons during accidental contact. In the instant invention these standard traffic cones are economically employed for conversion into whatever sandwich board and/or warning sign is required in particular traffic control areas.

To convert a traffic cone into the soft sandwich board of the invention essentially three items are required: (1) a shroud for covering the traffic cone; (2) a tee shaped, cone adapter with either a removable or permanent crossbar affixed to it; and (3) a cone base form. The shroud has a small opening at its top section, and a large opening at its bottom section, as visualized when connected to the traffic cone. Two sleeves for accommodating a crossbar are sewn or adhesively secured into opposite sides of the top opening in the shroud. The cone base form is preferably one or more cone weights. The cone base form has the shape of a large "nut" in that it has a circular opening so as to fit over the traffic cone, with the four sides of the form comprising a substantially square shape. The tee shaped, cone adapter has a hollow base portion so as to fit over the top of a traffic cone, with a similarly hollow top portion configured for accepting a crossbar (or with the crossbar permanently affixed to it) and, if required, traffic control accessories such as a warning light, flag, or sign. The crossbar can be a wood or plastic dowel, as, for example, polyvinylchloride.

The three items described above are connected to a standard traffic cone in the following manner. The crossbar on the tee shaped, cone adapter is fitted into the two sleeves in the shroud, with the information attachment portion of the adapter extending through the top center small opening in the shroud. With the top of the shroud now securing the tee shaped, cone adapter being grasped with one hand, the operator then places one or more cone base forms directly over the large bottom opening inside the shroud. The complete assembly of adapter, shroud, and cone base form are now placed over the traffic cone, the large opening in the shroud going over the narrow neck of the traffic cone first, and the assembly is then moved downward over the cone with the base of the shroud now being secured against the base of the traffic cone by the weight of the cone base form. While the shroud and cone base form is being lowered over the traffic cone, the hollow bottom opening in the tee shaped, cone adapter is fitted over the narrow neck of the traffic cone. The shroud, secured to the cross bar at the top of the cone, and with its large base opening secured over the square shaped cone base form adjacent the bottom of the cone, now assumes the typical two rectangularly sided shapes of a typical sandwich board.

The shroud can be made out of a variety of low wind resistance mesh materials, such as, for example, ultra violet stabilized nylon. A typical maximum size of a shroud would be 96" by 14". The shroud is sufficiently close weaved in order to permit printing of warnings or other information directly on the surface of the mesh. If required, reflecting materials can be applied to the shroud, or reflective strips can be adhesively secured. This combination of the shroud and standard traffic cone now provides an economical and easy to set up equivalent of the A-Stand sign systems with significant increase in safety. In case of accidents or high wind conditions the rubber traffic cone and soft shroud reduce the possibility of damage to nearby objects or injuring persons in the immediate area. In addition, the cone base forms employed for securing the shrouds are preferably high density rubber cone weights, which will further tend to limit the accidental motion of a soft sandwich board converted traffic cone. Other traffic control accessories, including warning lights, signs, and flags, can be attached to the tee shaped, cone adapter if this adapter is suitably configured to accept these accessories with, for example, an upstanding tube at the top of the adapter.

DETAILED DESCRIPTION

Figure 1:
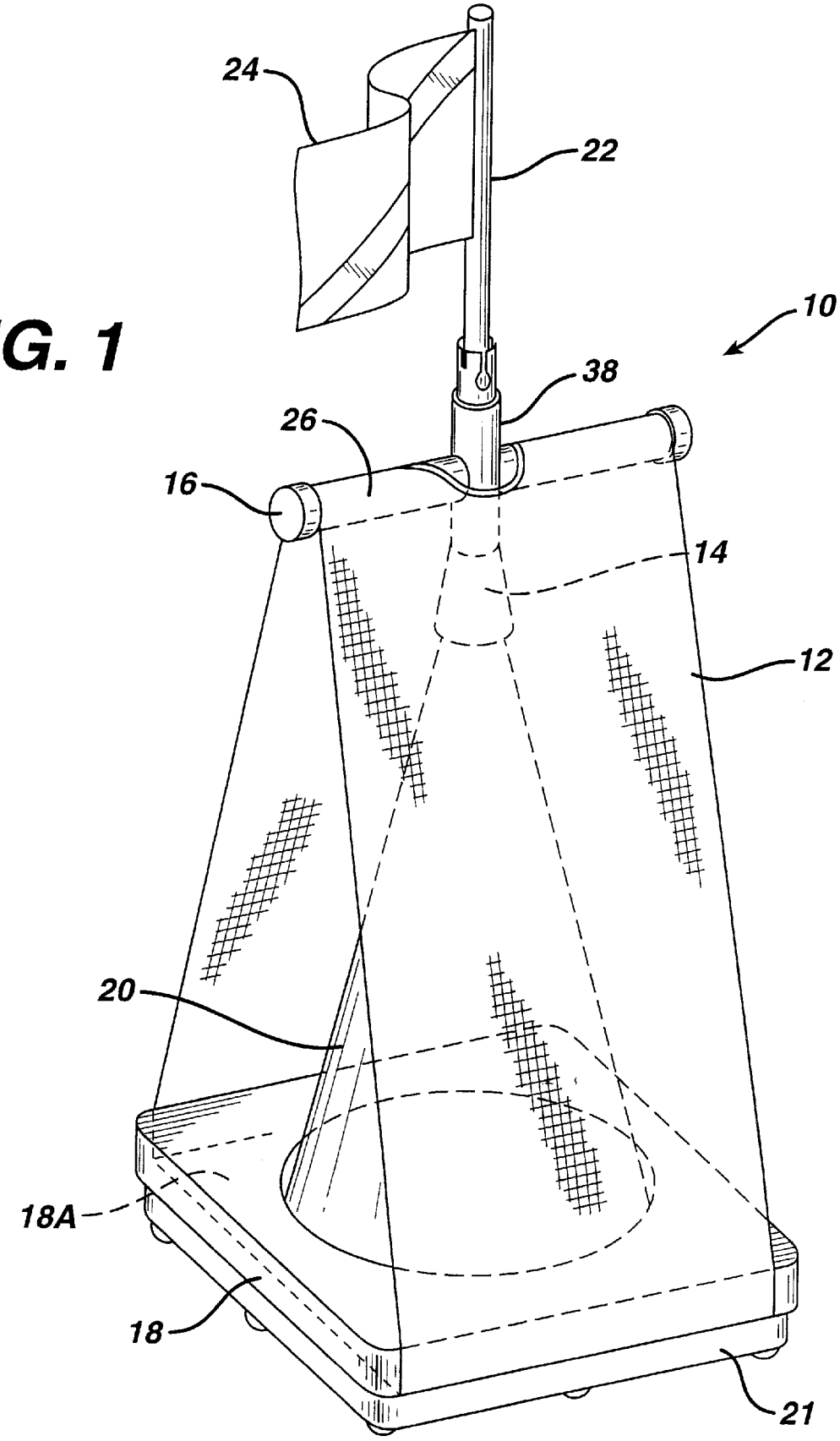
FIG. 1 is a partially sectional, perspective view of one version of the soft sandwich board system of the invention shown in place on a traffic cone, with a flag also secured to the traffic cone.
Figure 2A:
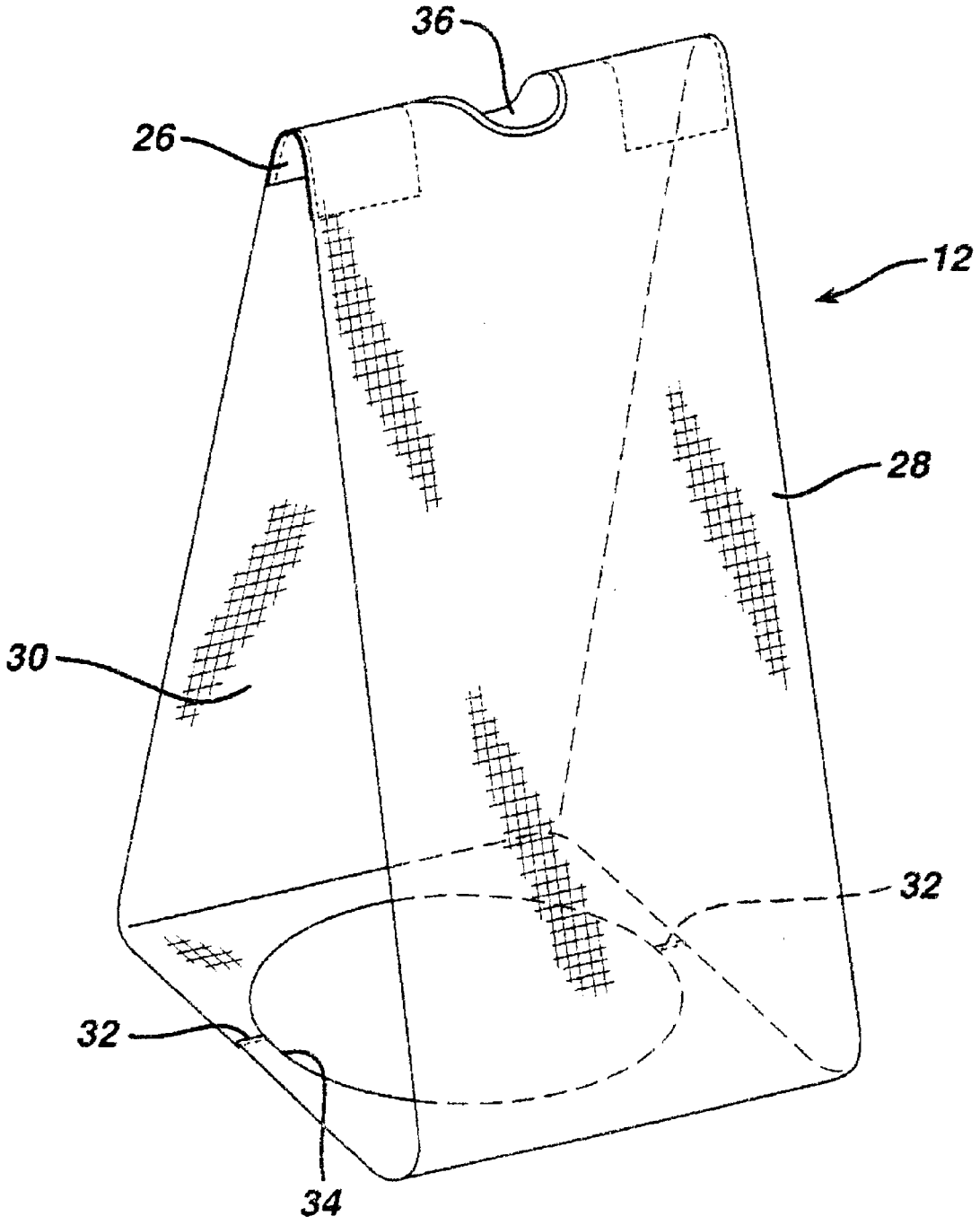
FIG. 2A is a partially sectional, perspective view of the shroud component of the system of the invention.
Figure 2B:
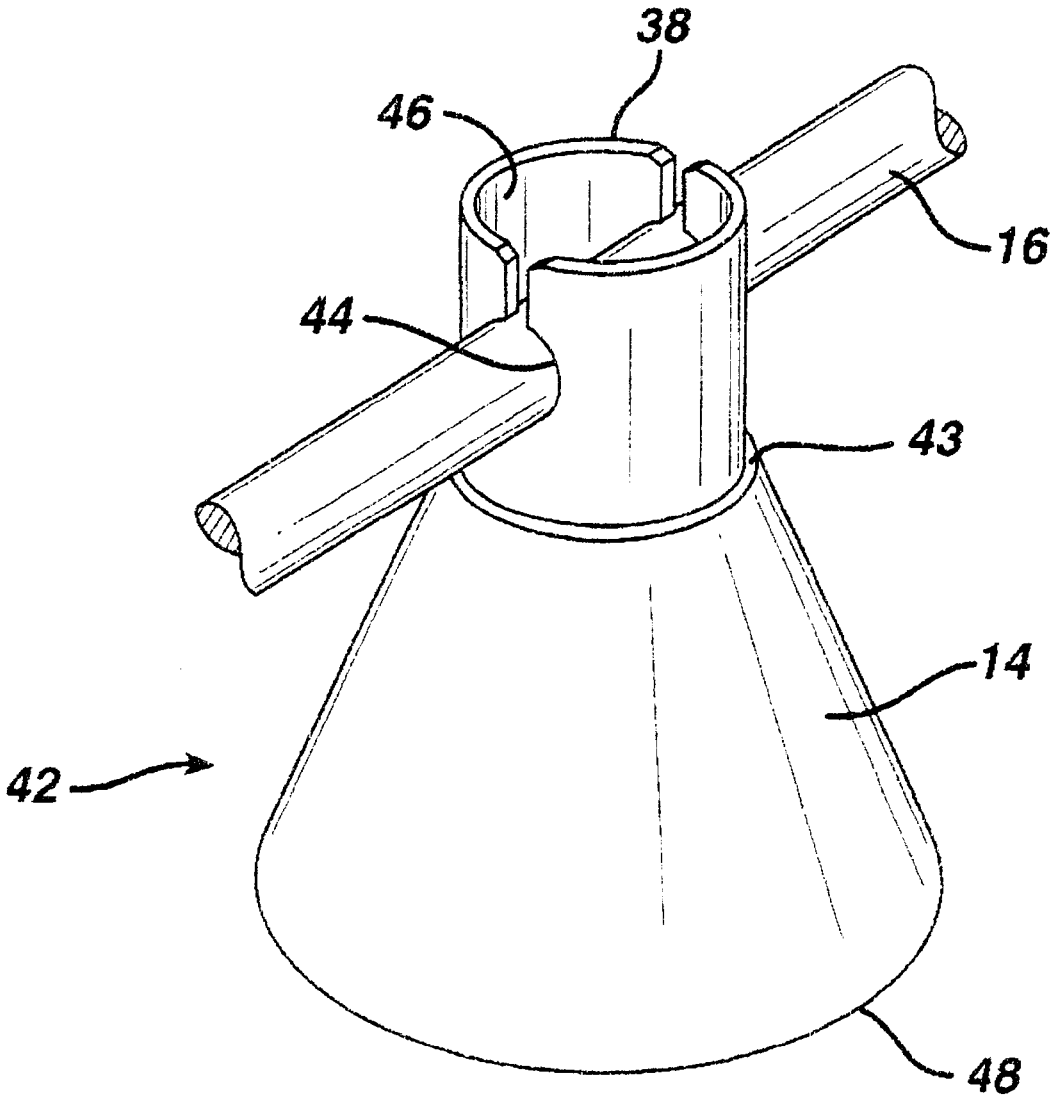
FIG. 2B is one version of the tee shaped, cone adapter component of the system of the invention shown with a cross bar secured within slots in the top section of the adapter.
Figure 2C:
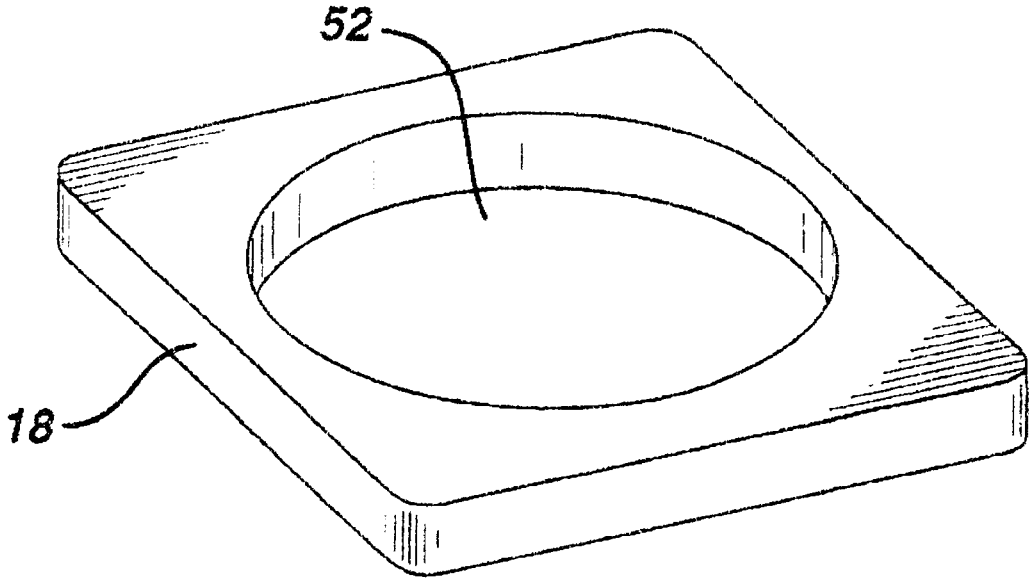
FIG. 2C is a perspective view of one version of the cone base form component of the system of the invention.

Referring now to the drawings, in FIG. 1 a complete version 10 of the sandwich board system of the invention is illustrated. As will be more fully explained, a shroud 12 is shown attached to a standard traffic cone. The components of the soft sandwich board system is best shown in FIGS. 2A, 2B, and 2C. In FIG. 2A a shroud 12 is shown. The shroud can be fabricated in a variety of materials, including cloth, plastic, or metal meshes. In a preferred embodiment an ultraviolet stabilized nylon mesh is employed. The mesh provides a low wind resistance material, yet is sufficiently fine so as to permit direct printing of traffic warning information directly on the material. To construct the shroud 12 a rectangular sheet of mesh of sufficient length and width is selected. A hole 36 is cut in the center of the rectangular shape, and two sleeves 26 are secured to the mesh, each one extending from the hole to opposite edges of the mesh, being positioned parallel to the center of the hole 36 and the edge of the mesh at its midpoint. The sheet of mesh is then folded in half with the center hole 36 now positioned at the center of the top portion of the sheet, and the two ends of the mesh forming the bottom of the sheet are secured together a spaced distance 32 along the bottom width of the mesh, beginning at the left and right hand corners of the mesh bottom, so that a relatively large opening 34 is defined at the base of the shroud. This large opening 34 is positioned concentric with the smaller opening 36 at the center of the top of the shroud.

FIG. 2B illustrates one version of a tee shaped, cone adapter 42 component of the invention. The adapter is preferably molded in a relatively soft plastic material, such as polyvinylcloride. The adapter 42 has a generally hollow structure, having an enlarged base portion 14 capable of fitting over the narrow end of a standard traffic cone 20 via an opening 48 in its base, and an upstanding top portion 38 having means for accepting a cross bar 16, and possible traffic control accessories such as a light, a sign, or a flag. The top portion 38 of the adapter 42 can, for example, extend above a flat, top shelf area 43 of the base portion of the adapter, this top portion being generally tubular in shape, having a center opening 46 and at least two openings 44 opposite one another in its side wall so that a crossbar 16 can be secured in a horizontal position making use of this adapter top portion 38. The crossbar 16 itself can be fabricated, for example, as a ¾" O.D. wooden dowel so as to minimize damage or harm to vehicles or individuals being accidentally struck by the crossbar.

FIG. 2C illustrates the cone base form (or cone weight) 18. The cone base form of the invention comprises a large "nut" shaped component having a center hole 52, with the four exterior sides of the form defining a generally square shape. When used as a cone weight, the form is preferably fabricated in a high density rubber so as to add additional weight, and therefore aid the stability of, to a standard traffic cone.

The assembly of one version of the invention is as follows:

1. A crossbar 16 secured, for example, in the above described tee shaped, cone adapter, is placed within the left and right sleeves 26 adjacent the small opening 36 at the top of the shroud. The top portion 38 of the adapter is permitted to project through the small opening in the shroud.
2. A cone base form 18 is placed within the shroud directly over the large opening 34 in the base of the shroud.
3. The large opening 34 portion of the shroud is now placed over the top of the traffic cone, the tee shaped, cone adapter being secured over the narrow neck of the cone, with the cone base form now resting on the base 21 of the traffic cone, securing the base of the shroud 18A beneath the cone base form 18.

Figure 3:
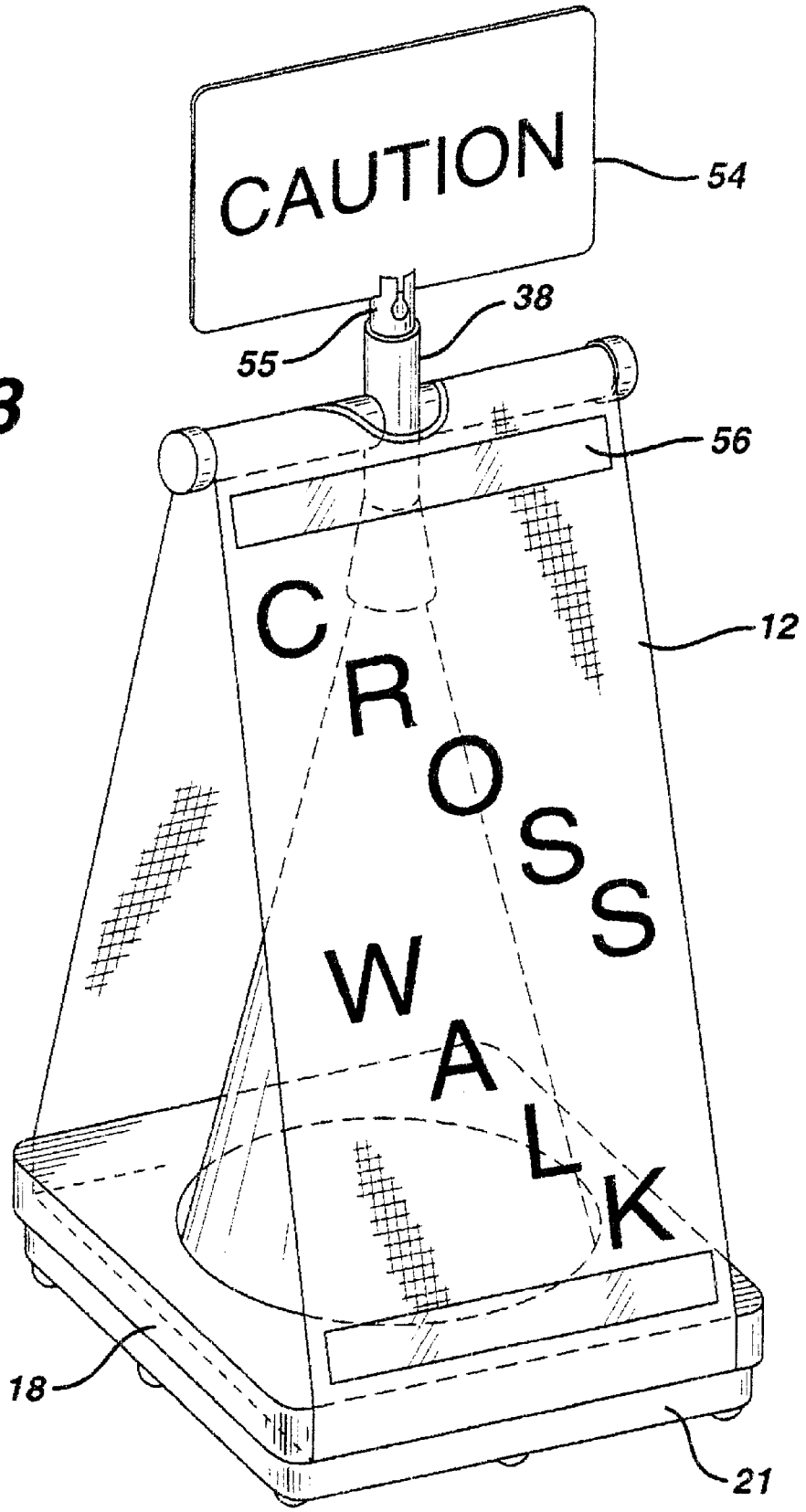
FIG. 3 is a perspective view of one version of the soft sandwich board system of the invention shown in place on a traffic cone, bearing a "Cross Walk" message and reflective bars, with a "Caution" sign also secured to the traffic cone.
Figure 4:
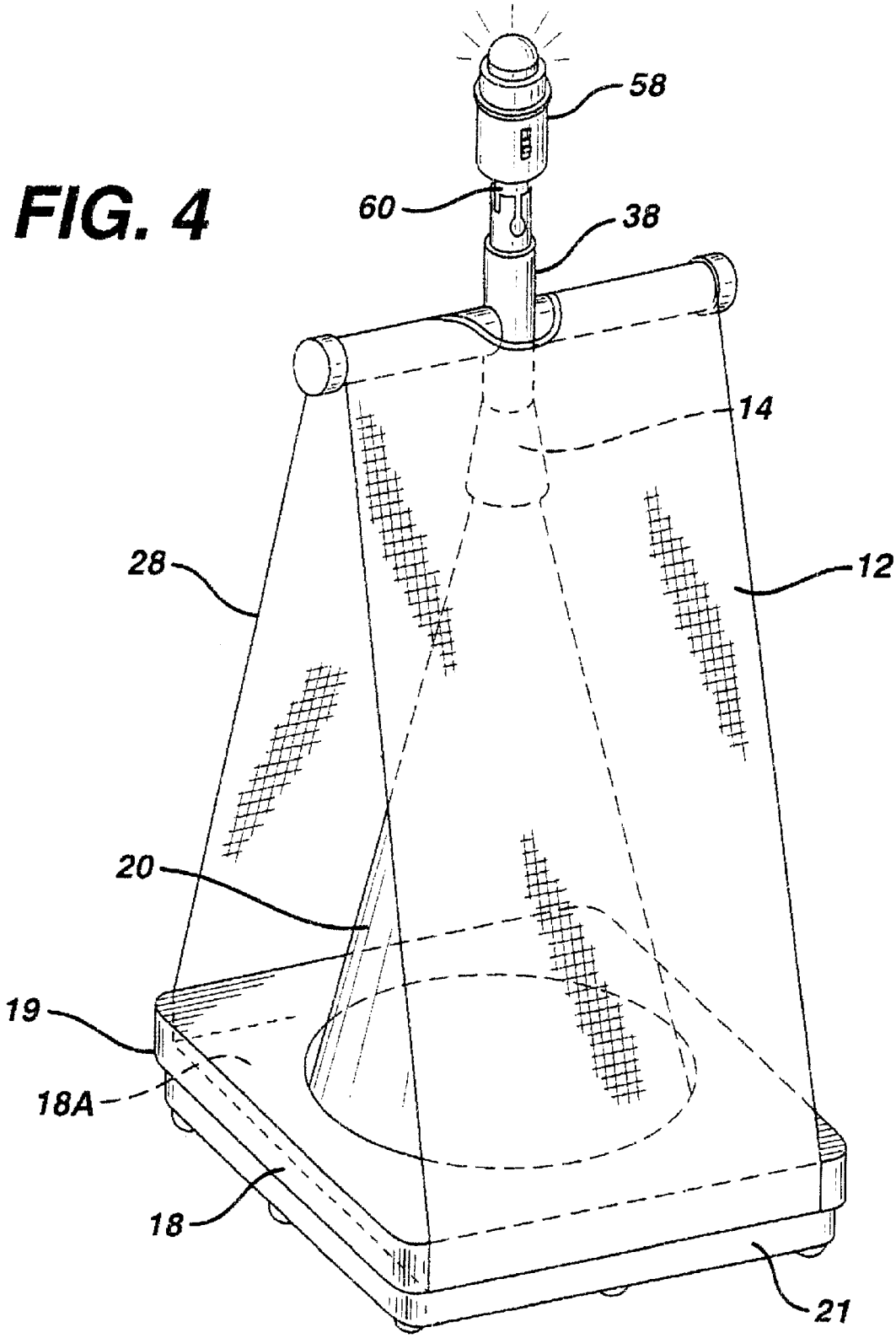
FIG. 4 is a perspective, side view of one version of the soft sandwich board system of the invention shown in place on a traffic cone, with a strobe light also secured to the traffic cone.

As clearly seen in FIGS. 1, 3, and 4, the soft sandwich board system of the invention now assumes the appearance and performs the function of prior A-Stand sign systems.

In FIG. 1 a flag staff 22 and flag 24 are shown as also being connected to a traffic cone, making use of the adapter 42 component of the invention. FIG. 3 illustrates a modified "CAUTION" sign 54 having a tubular connection 55 for securing the sign to the adapter. And in FIG. 4 a strobe light 58 is shown secured by its tubular base 60 to the adapter component of the invention. Again, referring to FIG. 3, the versatile nature of the soft sandwich board system is depicted, showing warning information, such as "CROSS WALK" being either connected to, or imprinted on the surface of the shroud. In addition, reflective bars 56 can similarly be removably secured to, or directly imprinted on the shroud surface.

Thus a new economical and versatile soft sandwich board system is disclosed for use in traffic control areas. By fabricating the board in a mesh material, and securing the board to standard rubber traffic cones by means of a rubber cone base form or cone weight, and light weight crossbar and plastic adapter, significantly greater safety is now provided to nearby persons or structures should the traffic cone be struck by a moving vehicle or subjected to violent wind conditions.

While the present invention has been disclosed in connection with versions shown and described in detail, various modifications and improvements thereon will become readily apparent to those skilled in the art. Accordingly, the spirit and scope of the present invention is to be limited only by the following claims.

What is claimed is:

1. A soft sandwich board system, comprising:

(a) a traffic cone including a narrow top having a small opening, a base having a large opening, and an outer surface;

(b) a crossbar;

(c) an adapter, said adapter connected to the top of said traffic cone, said adapter including means for retaining said crossbar, wherein said crossbar is positioned in a plane substantially parallel to the plane of the base of said traffic cone;

(d) a cone base form, said cone base form including an opening and having a first side and a second side substantially parallel to each other, the opening of said cone base form sized to permit disposition of said cone base form during assembly of said soft, sandwich board system, first over said top and then down towards said base of said cone, said cone base form finally positioned on said cone when said system is assembled, adjacent said base of said cone and in a plane which is substantially parallel to said base of said cone; and, (e) a substantially rectangularly shaped shroud having a length and a width, said shroud having a top surface and an under surface, said shroud including at least a first opening disposed at approximately the middle of said shroud, said shroud including a left side and a right side when said shroud is folded at the middle along a fold line denoting a middle width of said shroud, said left side and said right side of said shroud being substantially the same size and having the same shape, and each having a respective bottom end having a left and right hand corner, said first opening of said shroud disposed over said top of said traffic cone, said shroud supported along its fold line by said crossbar a spaced distance above said traffic cone base and cone base form when said soft, sandwich board system is assembled; and, (f) means for retaining the respective bottom ends of said left side and said right side of said shroud in position at the bottom of said soft, sandwich board system at said first and second sides respectively of said cone base form, whereby said shroud supported along its fold line and retained bottom ends of said left and right sides, at respective sides of said cone base form, achieves a sandwich board appearance.

2. The soft sandwich board system according to claim 1 wherein said shroud further comprises:

said left side and said right side of said shroud being secured together a spaced distance along the respective bottom ends beginning at the left hand and right hand comers of each respective bottom end thereby creating a second opening at the bottom ends of said shroud, said second opening of said shroud disposed between a bottom of said cone base form and said base of said cone during assembly of said soft sandwich board system.

3. The soft sandwich board system according to claim 1 wherein said adapter further comprises means for connecting traffic control accessories, including a light, a sign, and a flag.

4. The soft sandwich board system according to claim 1 wherein the length of said left side and said right side of said cone base form are substantially the same as the length of said crossbar, so that when said shroud is connected to said crossbar and to said left and right sides of said cone base form when connected to said traffic cone, said left side and said right side of said shroud forming substantially identical flat panels, diametrically opposite one another as positioned on said traffic cone.

5. A method for utilizing a standard traffic cone having a top, a base and outer walls so as to form a soft sandwich board system, comprising the steps of:

(a) creating a double sided shroud, said shroud having a top portion and a bottom portion, said shroud having a small hole at the center of said top portion and a large hole at the center of said bottom portion;

(b) securing a crossbar affixed to an adapter within said top portion of said shroud;

(c) securing a cone base form within said bottom portion of said shroud, said cone base form having a centrally positioned opening of sufficient diameter so as to fit over the outer walls of a standard traffic cone; and (d) slipping said assembled shroud, adapter, and form over a standard traffic cone so that said cone base form rests substantially at said base of said traffic cone with said bottom portion of said shroud secured between a top surface of a flange at said base of said traffic cone, and a bottom surface of said cone base form, and said adapter is secured at said top of said traffic cone, and said crossbar positioned so as to be in a plane substantially parallel to the plane of said base of said traffic cone, said soft sandwich board system is thereby formed.

* * * * *